US010822837B2

(12) United States Patent
Raz

(10) Patent No.: US 10,822,837 B2
(45) Date of Patent: Nov. 3, 2020

(54) OBLIQUELY-ENGAGING LOCKING MECHANISM

(71) Applicant: Dan Raz Ltd., Tirat Carmel (IL)

(72) Inventor: Amir Raz, Haifa (IL)

(73) Assignee: Dan Raz Ltd., Tirat Carmel (IL)

( * ) Notice: Subject to any disclaimer, the term of this patent is extended or adjusted under 35 U.S.C. 154(b) by 190 days.

(21) Appl. No.: 15/826,733

(22) Filed: Nov. 30, 2017

(65) Prior Publication Data

US 2019/0071895 A1 Mar. 7, 2019

Related U.S. Application Data

(63) Continuation-in-part of application No. PCT/IL2017/050984, filed on Sep. 3, 2017.

(51) Int. Cl.

| | |
|---|---|
| ***E05B 65/06*** | (2006.01) |
| ***E05B 63/24*** | (2006.01) |
| ***E05B 47/00*** | (2006.01) |
| ***E05C 19/00*** | (2006.01) |
| *E05B 47/02* | (2006.01) |
| *E05C 3/16* | (2006.01) |

(52) U.S. Cl.

CPC ..... *E05B 63/248* (2013.01); *E05B 47/0001* (2013.01); *E05B 47/0012* (2013.01); *E05C 19/002* (2013.01); *E05B 47/023* (2013.01); *E05C 3/16* (2013.01)

(58) Field of Classification Search

CPC ..... E05B 63/0052; E05B 63/24; E05B 65/06; E05B 65/0835; E05C 3/16; E05C 19/002; Y10S 292/71; Y10S 292/1075; Y10S 292/1078; Y10S 292/108; Y10S 292/1092

See application file for complete search history.

(56) References Cited

U.S. PATENT DOCUMENTS

| | | | |
|---|---|---|---|
| 313,742 | A | 3/1885 | Kintner |
| 435,658 | A | 9/1890 | Brennaman |
| 868,036 | A | 10/1907 | Tong |
| 1,185,422 | A | 5/1916 | Mammelli |
| 1,231,069 | A | 6/1917 | Scaffert |
| 1,609,342 | A | 12/1926 | Winters et al. |
| 1,973,461 | A | 9/1934 | Barringer |

(Continued)

FOREIGN PATENT DOCUMENTS

| | | |
|---|---|---|
| AU | 027346 | 2/1891 |
| AU | 641561 | 5/1992 |

(Continued)

*Primary Examiner* — Jerry E Redman

(74) *Attorney, Agent, or Firm* — Mark M. Friedman

(57) ABSTRACT

An apparatus includes a panel swingably mounted relative to a frame, and a locking element supported by a support arrangement. The support arrangement supports the locking element relative to the frame so as to be displaceable between a locked position in which at least part of the locking element is interposed between a pressure surface of the panel and a contact surface of the frame, thereby locking the panel to the frame, and an unlocked position. The support arrangement defines a path of motion of the locking element from an unlocked position to the locked position in which at least a terminal part of the path of motion is in a direction obliquely angled relative to a plane of closure of the panel within the frame.

13 Claims, 13 Drawing Sheets

(56) References Cited

U.S. PATENT DOCUMENTS 2,029,901 A 2/1936 Voight
2,108,965 A 2/1938 Gray
2,572,717 A 10/1951 Gersten
2,579,875 A 12/1951 Stanko
2,812,204 A 11/1957 Squire
2,834,066 A 5/1958 Lybarger
2,976,757 A 4/1961 Ammerman
3,002,592 A 10/1961 Quinn
3,019,493 A 2/1962 Walenga
3,159,093 A 12/1964 Rosenfeld
3,172,168 A 3/1965 Suska
3,222,098 A 12/1965 Hausfeld
3,596,954 A 8/1971 Hull et al.
3,634,962 A 1/1972 Peterson
3,841,516 A 10/1974 Marz
3,872,695 A 3/1975 Geringer
3,877,262 A 4/1975 Williams
3,877,282 A 4/1975 Pogonowski
3,924,884 A 12/1975 Christie
3,959,927 A 6/1976 Good
3,973,794 A 8/1976 Green
4,004,629 A 1/1977 Kelly
4,010,239 A 3/1977 Dor
4,045,065 A 8/1977 Johnson
4,056,276 A 11/1977 Jarvis
4,062,576 A 12/1977 Jennings et al.
4,106,239 A 8/1978 Bancroft et al.
4,110,867 A 9/1978 Gwozdz
4,126,965 A 11/1978 Hoffmann
4,133,142 A 1/1979 Dzus, Jr.
4,178,859 A 12/1979 Seiz
4,180,287 A 12/1979 Youngblood et al.
4,203,255 A 5/1980 MacDonald et al.
4,216,956 A 8/1980 Tsutomu et al.
4,216,966 A 8/1980 McNinch et al.
4,230,351 A * 10/1980 Bisbing ..... E05C 3/08 292/223
4,300,795 A 11/1981 Jennings
4,367,610 A 1/1983 Goode
4,428,153 A 1/1984 Klinger et al.
4,441,277 A 4/1984 Naylor
4,534,537 A 8/1985 Fleming
4,610,472 A 9/1986 Billingsley
4,643,005 A 2/1987 Logas
4,765,662 A 8/1988 Suska
4,824,154 A 4/1989 Simpson
4,831,779 A 5/1989 Kehrli et al.
4,856,830 A 8/1989 Chateau
5,137,327 A 8/1992 Edmonds
5,172,520 A 12/1992 Hostetler et al.
5,188,404 A 2/1993 Orendorff
5,224,297 A 7/1993 Watkins
5,319,882 A 6/1994 Biebuyck
5,325,141 A 7/1994 Gorman
5,349,782 A 9/1994 Yulkowski
5,361,539 A 11/1994 Widener
5,403,047 A 4/1995 Walls
5,409,272 A 4/1995 McCormack
5,465,460 A 11/1995 Cantone
5,465,480 A 11/1995 Karl et al.
5,570,915 A 11/1996 Asadurian
5,660,021 A 8/1997 Wolgamot
5,901,501 A 5/1999 Fountaine
5,927,773 A 7/1999 Larsen et al.
5,931,416 A 8/1999 Lingard et al.
6,185,071 B1 2/2001 Wang
6,185,871 B1 2/2001 Wang
6,286,274 B1 9/2001 McKann
6,363,832 B1 4/2002 Francis
6,409,234 B1 6/2002 Larsen et al.
6,564,428 B2 5/2003 Richard et al.
7,000,550 B1 2/2006 Mandall
7,182,374 B2 2/2007 Figge et al.
7,578,531 B1 8/2009 Leontaridis
7,707,776 B2 5/2010 Weissofner et al.
8,038,184 B2 10/2011 Grigis
8,146,393 B2 4/2012 Katagiri et al.
8,424,931 B2 4/2013 Chang
8,468,746 B2 6/2013 Salerno
8,534,000 B1 9/2013 Fadlon
8,627,606 B2 1/2014 Salerno et al.
8,707,625 B2 4/2014 Raz et al.
8,813,427 B2 8/2014 Meeks
8,925,249 B2 1/2015 Speyer et al.
9,145,719 B2 9/2015 Hartford
9,598,894 B2 3/2017 Raz
9,670,691 B2 6/2017 Mansueto et al.
9,702,168 B2 7/2017 Jadallah et al.
9,970,214 B2 * 5/2018 Raz ..... E05B 17/0025
9,988,830 B2 * 6/2018 Raz ..... E05B 63/248
10,138,654 B2 11/2018 Raz
10,221,595 B2 3/2019 Ward et al.
10,480,213 B2 11/2019 Raz
2002/0046501 A1 4/2002 Beckett et al.
2002/0095885 A1 7/2002 Sampson
2002/0145292 A1 10/2002 Furner
2002/0163208 A1 11/2002 Quigley
2004/0222649 A1 11/2004 Ito et al.
2005/0001436 A1 * 1/2005 Ramsauer ..... E05C 9/08 292/122
2006/0021400 A1 2/2006 Jackson
2007/0113478 A1 5/2007 Chu et al.
2007/0290456 A1 * 12/2007 Speyer ..... E05C 19/002 277/628
2008/0054123 A1 * 3/2008 French ..... B64C 1/1469 244/129.5
2008/0129054 A1 6/2008 Tremble et al.
2009/0289065 A1 11/2009 Sampson
2012/0204503 A1 8/2012 Helton
2013/0000205 A1 1/2013 Raz
2014/0190098 A1 7/2014 Raz et al.
2014/0259946 A1 9/2014 Mansueto et al.
2015/0123411 A1 5/2015 Woo
2016/0001643 A1 1/2016 Ichikawa
2016/0032627 A1 2/2016 Yoshino et al.
2016/0076275 A1 3/2016 Uemura et al.
2016/0076280 A1 3/2016 Rudraraju et al.
2016/0083976 A1 3/2016 Rickenbaugh et al.
2017/0152676 A1 * 6/2017 Raz ..... E05B 17/0025
2017/0204621 A1 6/2017 Procton et al.
2017/0254119 A1 * 9/2017 Raz ..... E05B 17/2007
2017/0254125 A1 * 9/2017 Raz ..... E05B 63/248
2018/0209175 A1 7/2018 Raz
2018/0252025 A1 9/2018 Raz
2018/0266153 A1 9/2018 Marsh
2019/0071895 A1 * 3/2019 Raz ..... E05B 47/0012

FOREIGN PATENT DOCUMENTS

CA 1029063 4/1978
CN 107923197 4/2018
DE 890012 9/1953
DE 929592 6/1955
DE 3447796 7/1968
DE 890001 3/1969
DE 2628036 1/1977
DE 2652562 6/1977
DE 2852670 6/1980
DE 3447796 7/1985
DE 8438238 12/1987
DE 29517077 2/1997
DE 10117173 10/2002
DE 10322798 12/2004
DE 102004054961 8/2007
DE 10329560 6/2012
EP 67075 12/1982
EP 0094461 11/1983
EP 0067075 12/1985
EP 0270437 6/1988
EP 0811738 12/1997
EP 1422358 5/2004
EP 1574657 9/2005
EP 1775403 4/2007
EP 2726688 5/2014

(56) References Cited

FOREIGN PATENT DOCUMENTS

| | | | |
|---|---|---|---|
| EP | 3341542 | | 7/2018 |
| EP | 3347557 | | 7/2018 |
| FR | 469276 | | 7/1914 |
| FR | 2631068 | | 11/1989 |
| FR | 2844822 | | 3/2004 |
| FR | 2891295 | | 3/2007 |
| GB | 1399058 | A | 6/1975 |
| GB | 2195958 | A | 4/1980 |
| GB | 2154639 | B | 6/1987 |
| GB | 2233701 | A | 1/1991 |
| GB | 2250772 | A | 6/1992 |
| GB | 2521932 | A | 7/2015 |
| WO | 2013001488 | | 1/2013 |
| WO | 2013001488 | A1 | 1/2013 |
| WO | 2013018496 | | 3/2015 |
| WO | 2017033177 | | 3/2017 |
| WO | 2017042799 | | 3/2017 |
| WO | 2017090020 | | 6/2017 |
| WO | 2017149544 | | 9/2017 |
| WO | 2017149545 | | 9/2017 |

* cited by examiner

OBLIQUELY-ENGAGING LOCKING MECHANISM

FIELD AND BACKGROUND OF THE INVENTION

The present invention relates to locking arrangements and, in particular, it concerns an apparatus including an obliquely engaging locking mechanism.

It is known to employ various bolts extending between a frame and a panel, such as a door or window. A bolt is typically exposed to shear forces when opposing forces acting to open the panel.

SUMMARY OF THE INVENTION

The present invention is an apparatus including an obliquely engaging locking mechanism.

According to the teachings of an embodiment of the present invention there is provided, an apparatus comprising: (a) an opening bounded by a frame, the frame defining a plane of closure; (b) a panel swingably mounted relative to the frame so as to be swingable between an open position removed from the opening and a closed position in which the panel is aligned parallel to the plane of closure; (c) a locking element; and (d) a support configuration deployed for supporting the locking element relative to the frame so as to be displaceable between a locked position in which at least part of the locking element is interposed between a pressure surface defined on the panel and a contact surface defined on the frame, thereby locking the panel to the frame, and an unlocked position in which the locking element is removed from between the pressure surface and the contact surface, thereby unlocking the panel from the frame, wherein the support configuration is configured to define a path of motion of the locking element from the unlocked position to the locked position, and wherein at least a terminal part of the path of motion approaching the locked position is in a direction of motion that is obliquely angled relative to the plane of closure.

According to a further feature of an embodiment of the present invention, the direction of motion is inclined at between 10° and about 60°, and more preferably between 20° and about 45°, to the plane of closure.

According to a further feature of an embodiment of the present invention, the path of motion is a linear path of motion.

According to a further feature of an alternative embodiment of the present invention, the path of motion is an arcuate path of motion along an arc having a radius greater than a distance between the pressure surface and the contact surface.

According to a further feature of an embodiment of the present invention, in the closed position, the pressure surface and the contact surface are in facing relation such that force applied to displace the panel towards the open position is opposed by compressive forces applied on the locking element between the pressure surface and the contact surface.

According to a further feature of an embodiment of the present invention, the panel, the locking element and the support configuration are configured such that, when the panel is displaced from the open position towards the closed position, the panel displaces the locking element temporarily from the locked position towards the unlocked position to allow displacement of the panel to the closed position.

According to a further feature of an embodiment of the present invention, there is also provided an actuation mechanism comprising a mechanical coupling selectively displaceable so as to displace the locking element from the locked position towards the unlocked position.

According to a further feature of an embodiment of the present invention, the mechanical coupling comprises a manually-operable handle.

According to a further feature of an embodiment of the present invention, the actuation mechanism further comprises a powered actuator deployed for selectively displacing the mechanical coupling.

According to a further feature of an embodiment of the present invention, at least part of the mechanical coupling is mounted on the panel.

According to a further feature of an embodiment of the present invention, at least part of the mechanical coupling is mounted on the frame.

The terms "shift" and "displace" as used herein the specification and claims refers generically to any mechanical displacement of various elements including but not limited to linear displacement, pivot movement, rotational movement and combinations thereof. The term "panel" is used to refer to the element deployed across at least part of the opening in the closed state. The panels and corresponding closures may be doors, windows or any other type of opening which is selectively closed (or partially closed) by a hinged or otherwise swingable panel.

The phrase "mounted on" as used herein refers to a first element affixed to a second element in any disposition between the two elements including the first element disposed on the second element, inside the second element, affixed to any outer or inner surface of the second element, etc.

The phrase "defined on" as used herein refers to a feature or an element provided on a member in any manner, including integrally formed with the member, attached to the member etc.

The term "door" as used herein the specification and claims refers generically to any moving panel configured to selectively block off and allow access through an opening to a structure, such as a building or vehicle, an entrance to a confined area, or between two confined areas including a hinged door or window, whether with a simple hinge or a more complex mounting providing a swinging opening/closing motion, as well as a hood and a trunk for covering vehicles or portions thereof, etc.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 2A:
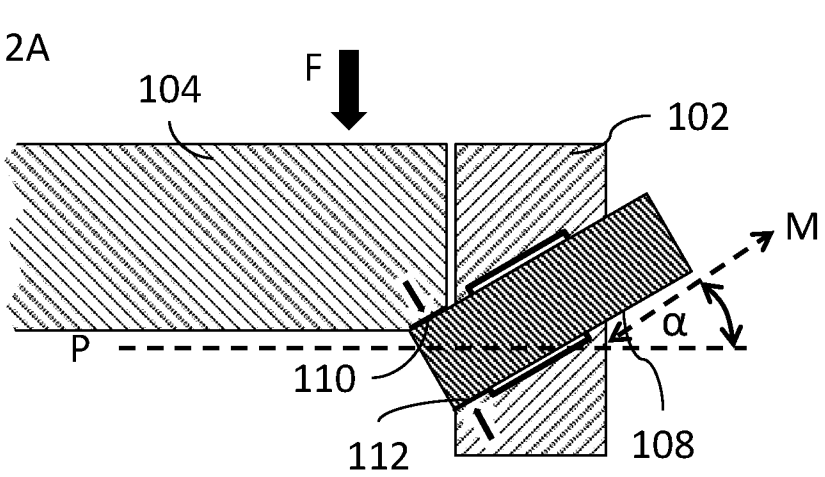
FIG. 2A is a schematic horizontal cross-sectional view illustrating a locking geometry as implemented in various embodiments of the present invention.

The present invention is an apparatus including an obliquely engaging locking mechanism.

The principles and operation of an apparatus according to the present invention may be better understood with reference to the drawings and the accompanying description.

Referring now to the drawings generically, certain embodiments of the present invention as illustrated herein provide an apparatus 100 including an opening bounded by a frame 102 that defines a plane of closure P (FIGS. 2A, 3, 7, 10 and 11), and a panel 104 swingably mounted, typically via hinges 106, relative to frame 102 so as to be swingable between an open position removed from the opening and a closed position in which panel 104 is aligned parallel to plane of closure P.

The apparatus further includes a locking element 108, 202 or 902, and a support configuration (described below) deployed for supporting the locking element relative to frame 102 so as to be displaceable between a locked position (FIGS. 2A, 3, 4A, 7, 10 and 11) in which at least part of the locking element is interposed between a pressure surface 110 of panel 104 and a contact surface 112 of the frame 102, thereby locking the panel to the frame, and an unlocked position in which the locking element 108, 202, 902 is removed from between the pressure surface and the contact surface, thereby unlocking panel 104 from frame 102.

It is a particular feature of certain particularly preferred implementations of the present invention that the support configuration is configured to define a path of motion of locking element 108, 202, 902 from the unlocked position to the locked position, wherein at least a terminal part of the path of motion approaching the locked position is in a direction of motion M that is obliquely angled relative to the plane of closure P.

The term "oblique" or "obliquely angled" is used herein in the description and claims according to its normal meaning to refer to directions, planes or a direction relative to a plane which is inclined so as to be neither parallel nor perpendicular. Oblique thus typically refers to inclinations between about 5° and about 85°. In certain preferred implementations of the present invention, the direction of motion M is inclined at an angle $\alpha$ of between about 10° and about 60°, and more preferably between about 20° and about 45°, to the plane of closure P. The direction of motion M is most preferably also perpendicular to a direction of extension of frame 102 (and the edge of panel 104).

The use of an obliquely angled path of motion for at least the end of the motion of the locking element to its locked position facilitates a design in which a force F applied to displace panel 104 towards its open position is opposed by compressive forces applied on the locking element, in contrast to the shear forces typically generated on a bolt that lies parallel to the plane of closure. This contrast is illustrated particularly by comparing the configurations of FIGS. 2A and 2B.

Specifically, referring to FIG. 2A, in the closed position of panel 104 as shown, pressure surface 110 and contact surface 112 are preferably in facing relation. "Facing relation" is used in this context, in the description and claims, to refer to a pair of surfaces for which a line projecting normally (perpendicular) to part of one of the surfaces intersects part of the other surface, and most preferably, vice versa. Most preferably, the pressure surface 110 and the contact surface 112 are parallel to each other, and to direction of motion M. As a result of this geometrical relation, a force F applied to displace the panel towards the open position is opposed by compressive forces applied on locking element 108 between pressure surface 110 and contact surface 112, illustrated by small arrows adjacent to those surfaces.

Figure 2B:
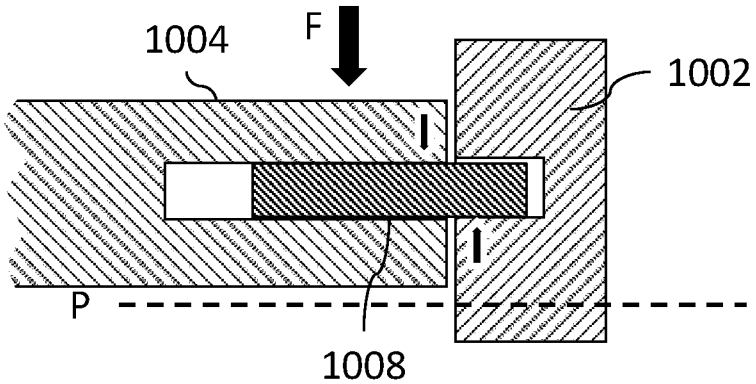
FIG. 2B (PRIOR ART)
FIG. 2B is a schematic horizontal cross-sectional view showing a convention bolt geometry.
Figure 1:
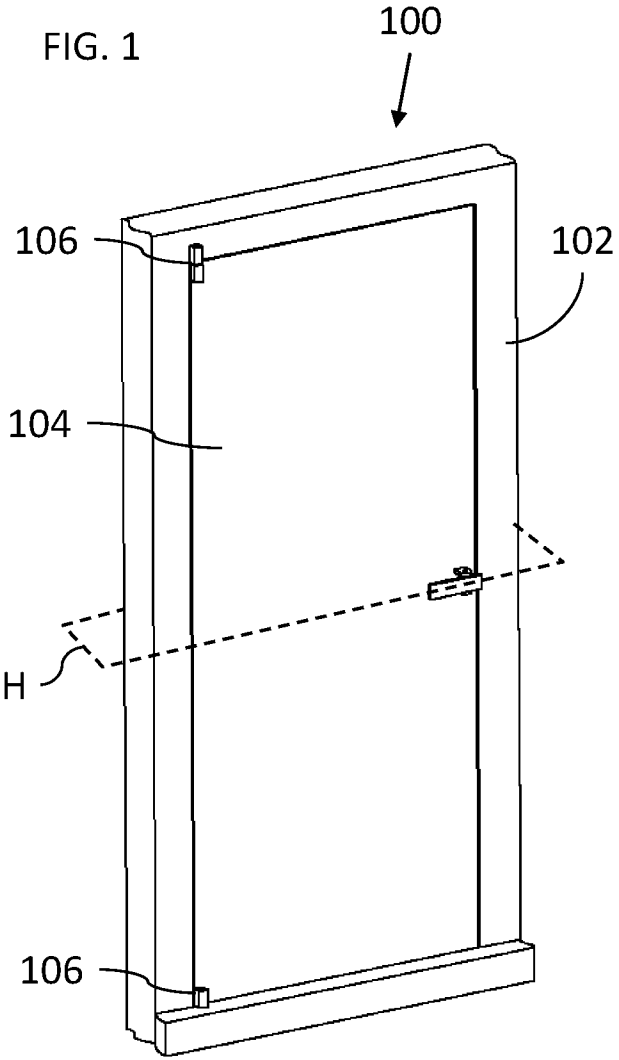
FIG. 1 is an isometric view of an apparatus, constructed and operative according to the teachings of an aspect of the present invention, including a panel swingably mounted in a frame, and showing a horizontal plane "H" on which all cross-sectional views described below are taken.
Figure 3:
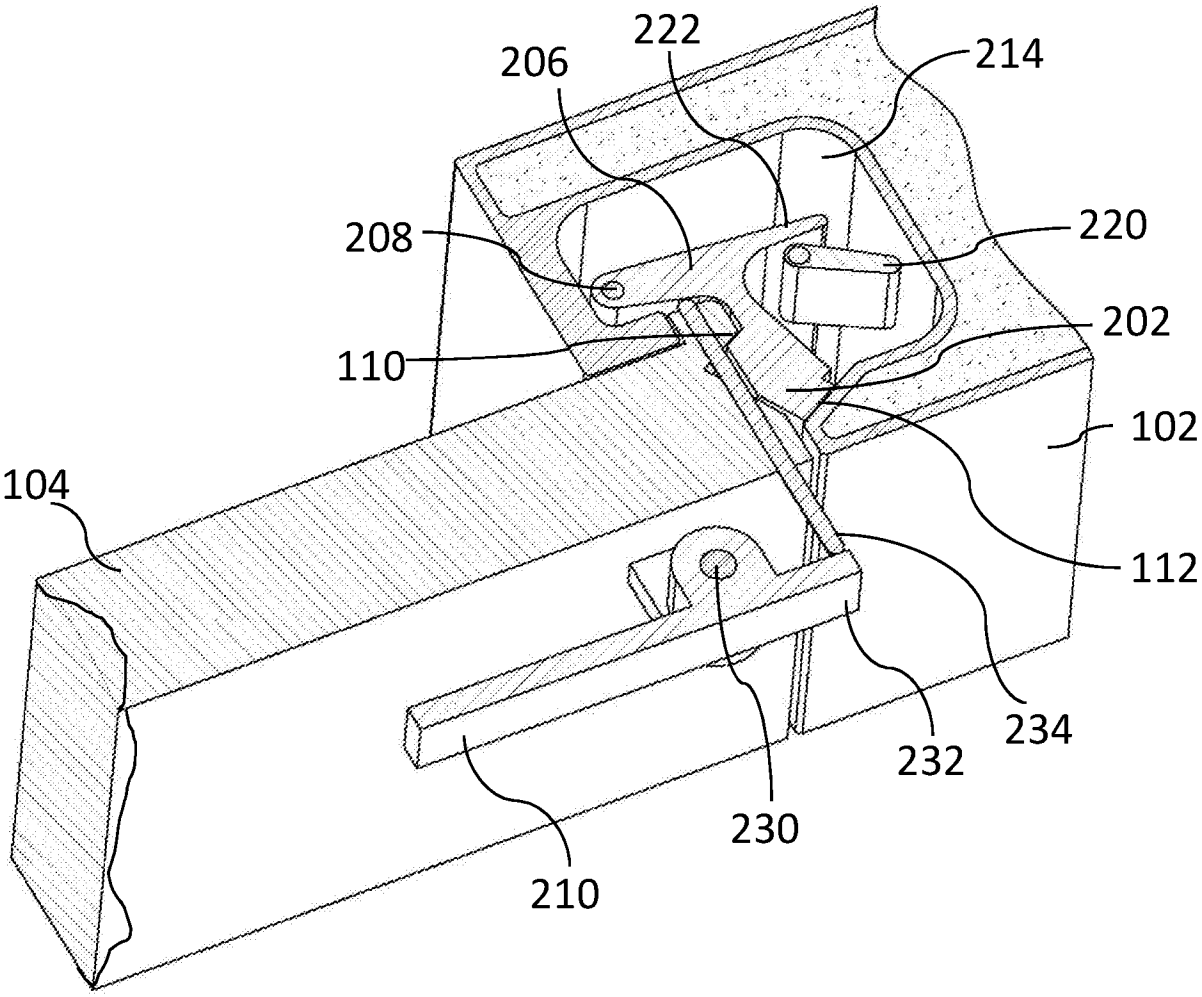
FIG. 3 is a partial, cut-away isometric view of a first embodiment of the apparatus of FIG. 1, the apparatus being cut away along a horizontal plane passing through a handle of the panel.

This contrasts clearly to a conventional bolt geometry, where the bolt moves parallel to the plane of closure, as illustrated in FIG. 2B. In this case, a force F applied to a panel 1004 to move it relative to a frame element 1002 generates shear forces on a bolt 1008, as represented by the small arrows.

Although the description here is directed by way of a non-limiting example to a door, it will be appreciated that the locking mechanism can be equally implemented in the context of a window or any other situation where a displaceable panel is selectively locked in place across an opening. In one set of examples illustrated herein, the lock mechanism is illustrated in the context of a hinged panel. In that case, the default deployment is typically on the strike jamb, i.e., at the side opposite the hinge. It should be noted however that the various mechanisms described may equally be deployed on a frame edge adjacent to the hinge side, or in the context of a panel which has two modes of opening in which the effective hinge can be along either of two sides of the panel. The invention may also be applied to situations where a hinge axis is located in the middle of a panel, or at any other position across a panel, or where more complex hinge arrangements define a virtual hinge outside the area of the panel, or any more complex motion.

Use of a locking element that is introduced at an oblique angle with respect to the panel when in the locked state provides significant advantages in that forces acting on the panel to try to open the panel away from the frame element are converted primarily, if not exclusively, into compressive forces on the locking element. This provides enhanced security of locking for a given locking element compared to a similar locking element that is exposed to bending or shear forces (that commonly dominate in conventional bolts). When combined with the use of a locking element which extends along a significant portion (typically at least 10%, and in some cases along a majority) of a dimension of the panel, this configuration results in highly secure locking, even when using relatively soft materials. Thus, according to certain preferred embodiments of the present invention, the locking element may in fact be formed from relatively soft materials, such as various polymer materials, and may employ various combinations of materials as layers, coatings or composites.

Figure 4A:
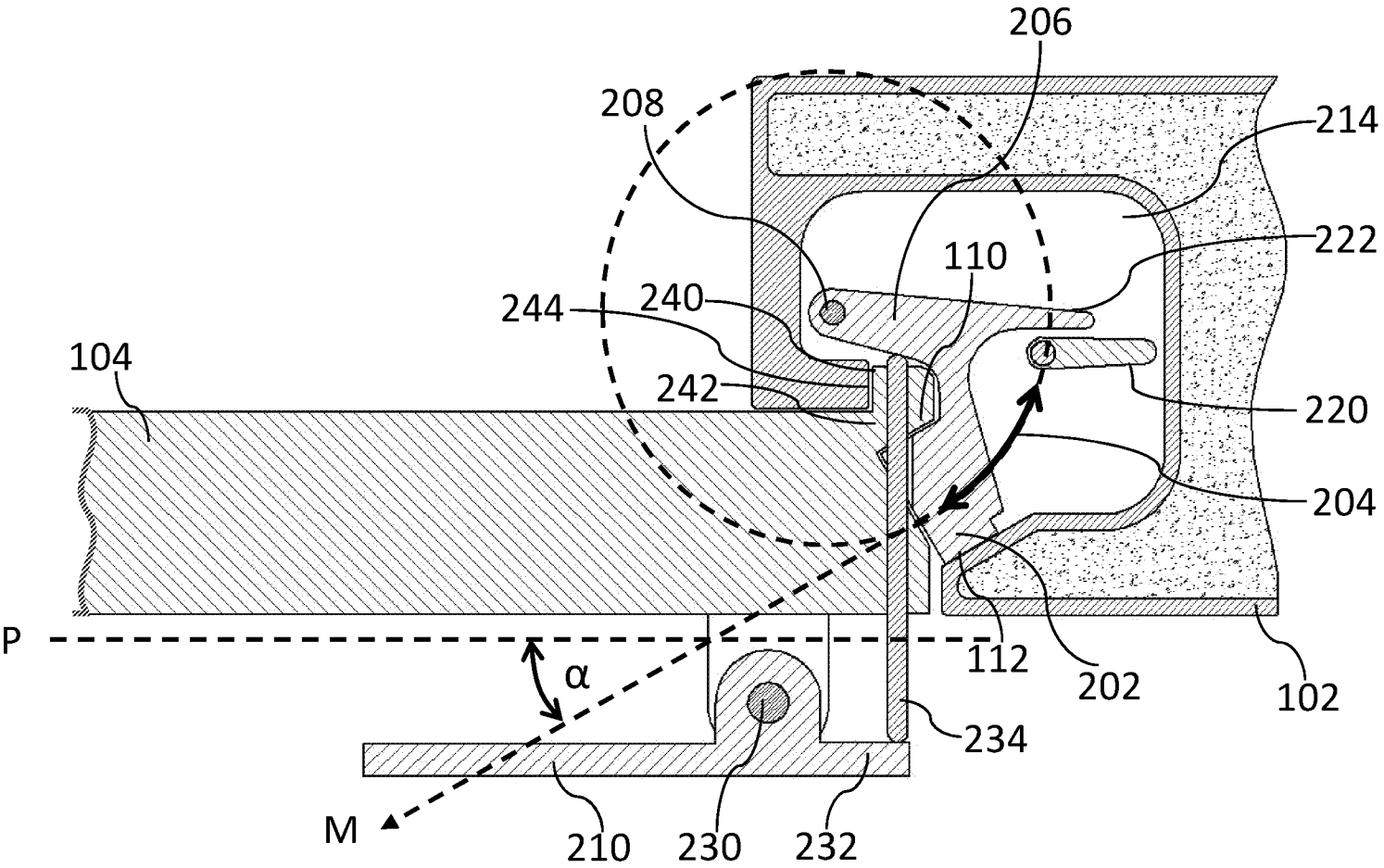
FIG. 4A is a partial cross-sectional view of the embodiment of FIG. 3 showing a locking element in a locked state.

Turning now to a first non-limiting exemplary implementation of an aspect of the present invention, FIGS. 3-6E illustrate an implementation in which the path of motion of a locking element 202 is an arcuate path of motion, designated by arrow 204 in FIG. 4A, along an arc. A radius of this arc, for at least part of locking element 202, and preferably for the entirety of the locking element 202, is greater than a distance between pressure surface 110 and the contact surface 112, corresponding to a width dimension of the locking element 202. Direction of motion M in this case is defined be a tangent to the arcuate path at the point in the motion at which the locking element reaches its locked position. The arcuate path of motion is typically achieved by a support configuration implemented as a supporting structure 206 for locking element 202 which rotates about a pivot axis, provided here by an axle 208. The support structure may be integrally formed with, or attached to, locking element 202, and is preferably biased, such as by a spring element (not shown) to its locked position. The entire assembly is preferably deployed within an internal cavity 214 of one side of frame 102, as shown.

Figure 4B:
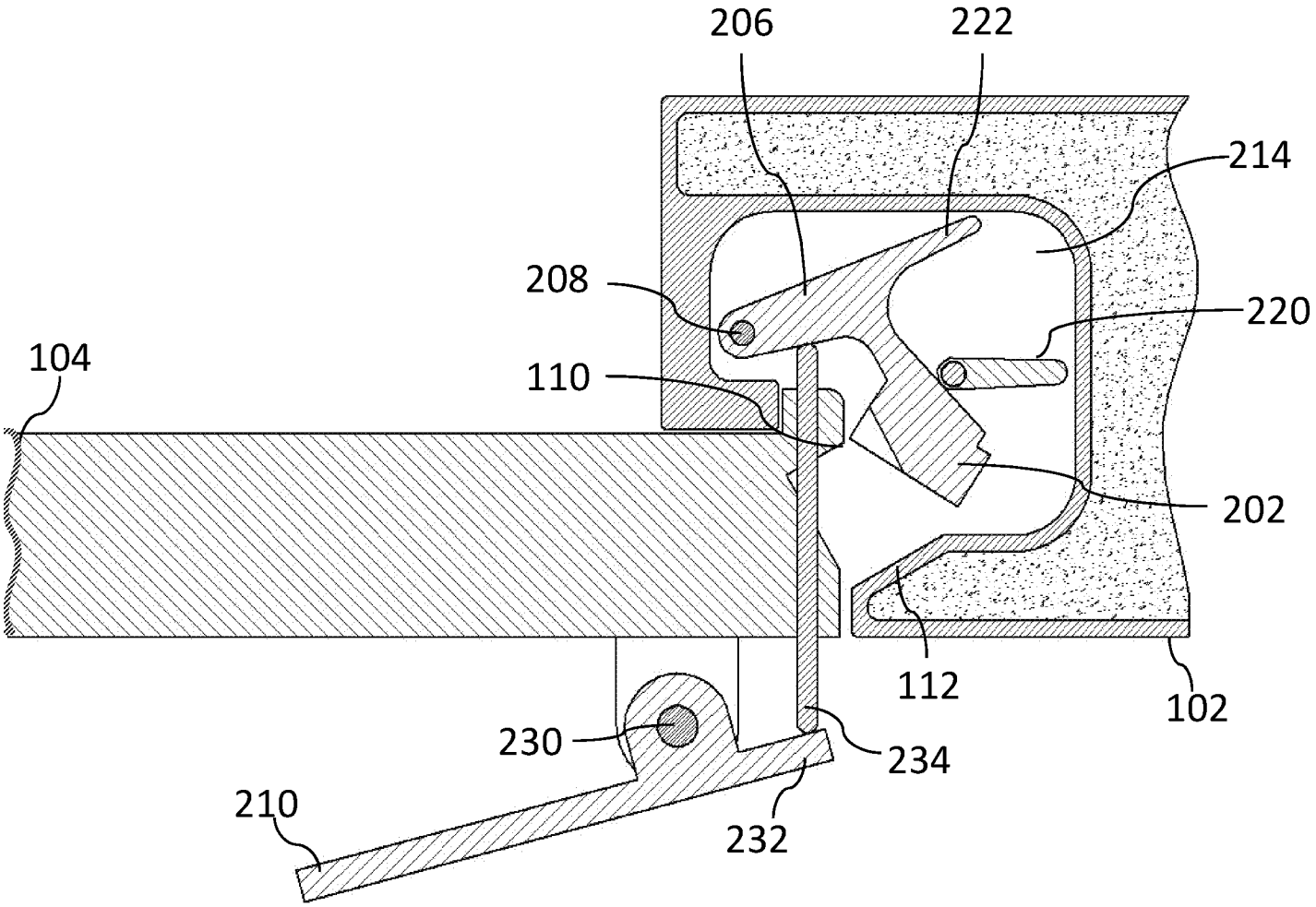
FIGS. 4B-4D are views similar to FIG. 4A showing a sequence of states of the mechanism during opening of the panel using a manually operated handle.

Use of a relatively large radius of arcuate motion allows the locking element 202 to selectively engage between pressure surface 110 and the contact surface 112 in the locked position, and to be removed from the volume between those surfaces in the unlocked state, as will be seen in FIG. 4B. The exact path of motion is defined by the distance from the pivot axis to the locking element, while the angle of the direction of motion M at the end of the locking motion is defined by the location of the pivot axis. In the particularly preferred case illustrated here, the pivot axis is located on the side of the plane of closure that is away from the direction in which the panel opens, and somewhat inwards from the outer edge of the panel, although other locations for the pivot axis may be used so long as they define a motion of the locking element 202 that satisfies the above general definition.

Unlocking of the lock mechanism can be achieved by various manually operated or powered mechanisms mounted on the panel and/or on the frame. In the particularly preferred but non-limiting example illustrated here, the assembly is provided with a manually-operable panel-mounted handle 210 for opening the panel from one side, and a powered mechanism mounted in the frame for powered unlocking. The sequence of opening using handle 210 is illustrated in FIGS. 4A-4D.

Handle 210 is pivotally mounted on a hinge 230 relative to panel 104, and has a projecting portion 232 extending to the side of hinge 230 opposite to the main part of handle 210. Projecting portion 232 cooperates with a push-rod 234 extending through, or adjacent to, panel 104 so as to be displaceable in a direction roughly perpendicular to the plane of closure, and is deployed to bear on a region of supporting structure 206. Clearly, this particular geometrical arrangement may be varied according to the considerations of various different designs.

Figure 4D:
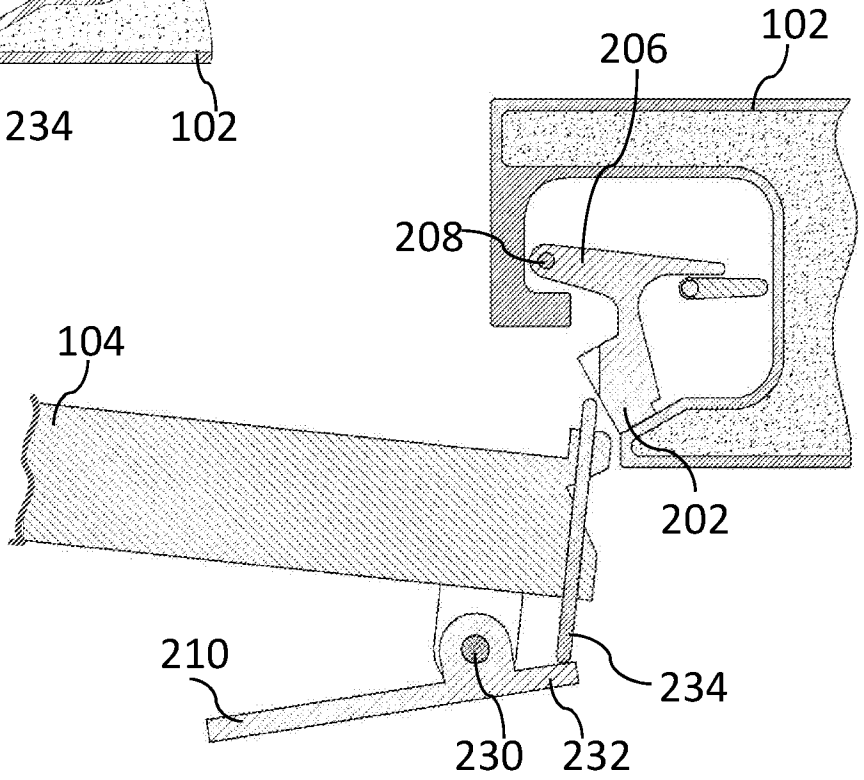
Figure 4C:
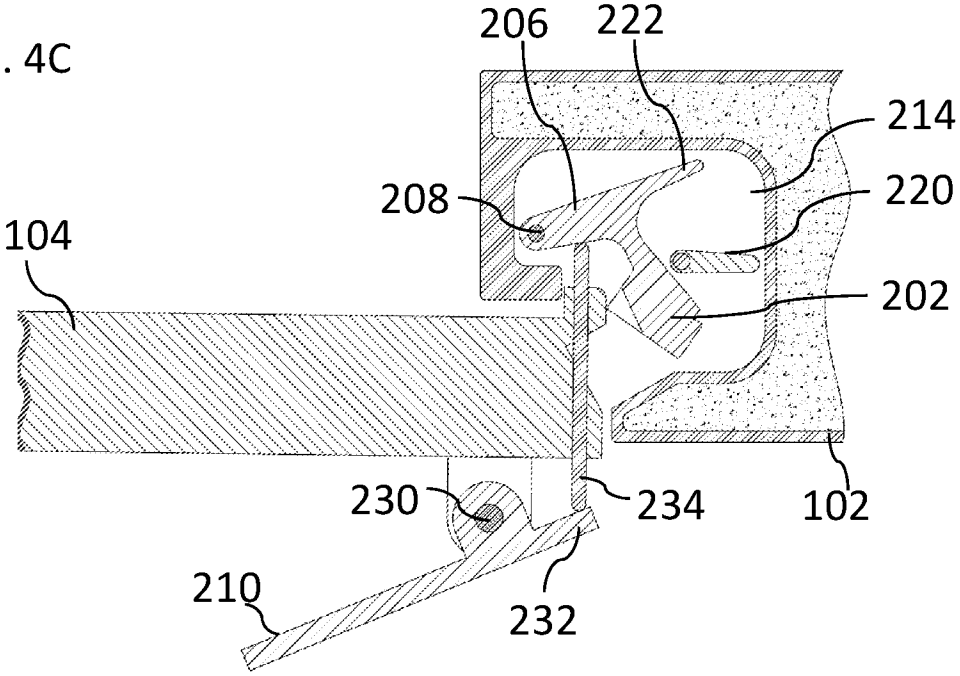

As a result of this structure, when handle 210 is pulled away from panel 104, the handle pivots about hinge 230, causing projecting portion 232 to bear on the end of push-rod 234, pressing in turn on supporting structure 206 so as to pivot the entire locking element block about axle 208. The displaced state as shown in FIG. 4B ensures that locking element 202 is withdrawn from the space between pressure surface 110 and contact surface 112, thereby allowing swinging open of panel 104 as shown in FIGS. 4C and 4D.

Figure 5B:
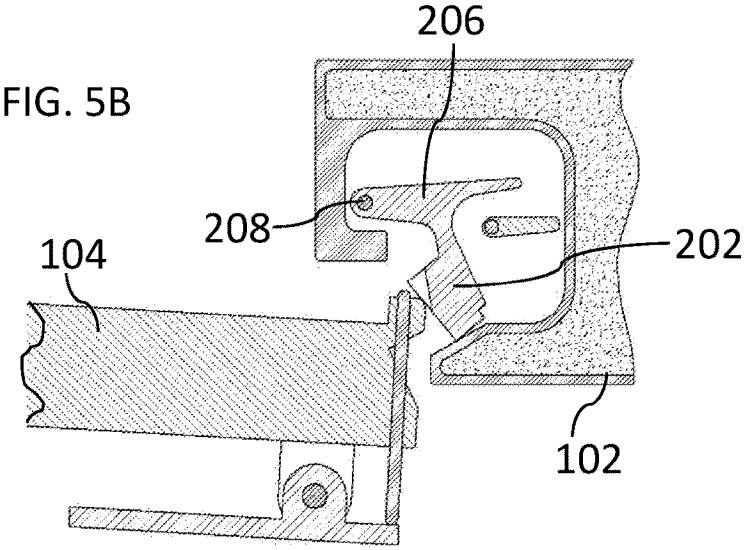
FIGS. 5A-5D are views similar to FIG. 4A showing a sequence of states of the mechanism during closing of the panel.
Figure 5D:
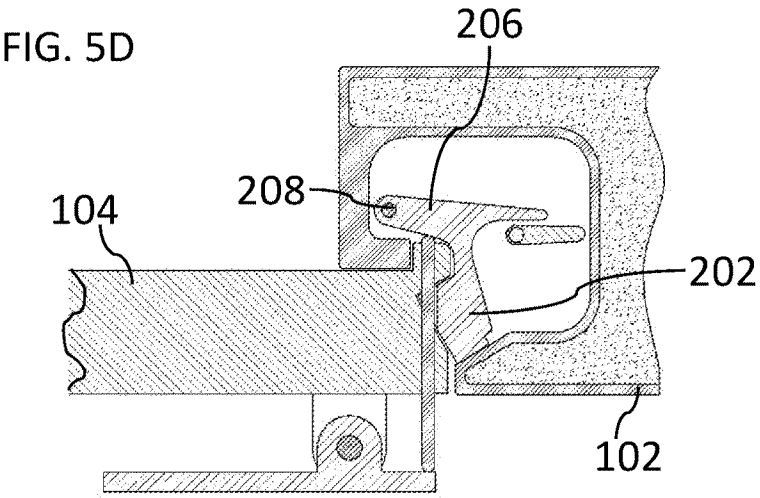
Figure 5A:
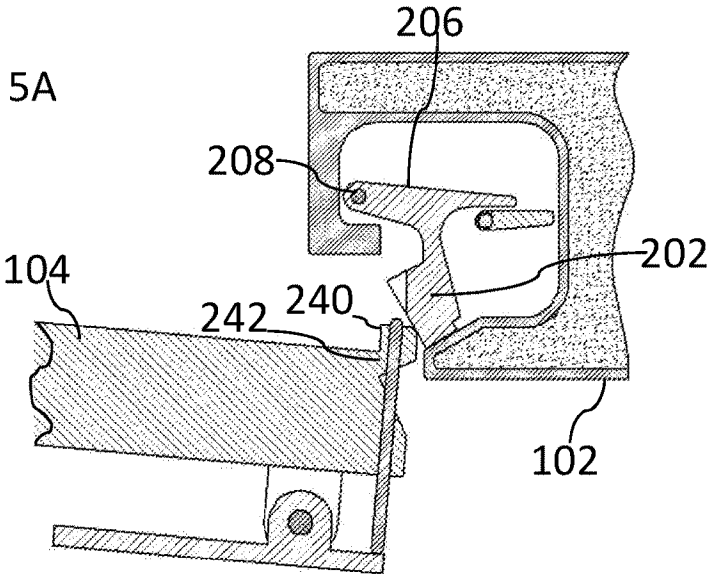
Figure 5C:
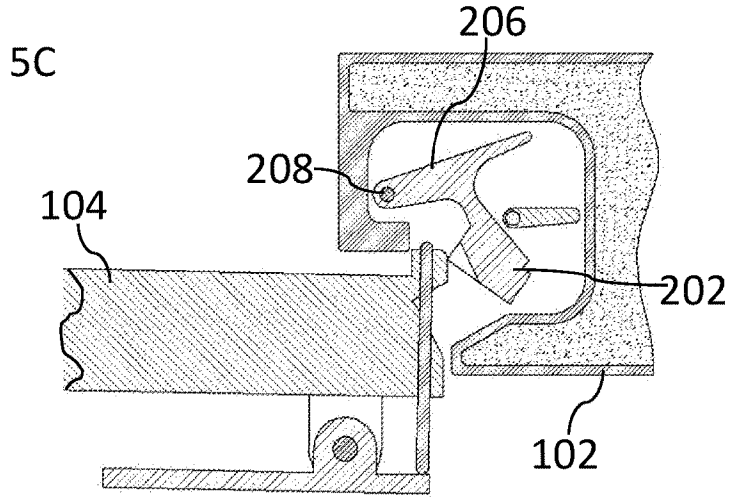

According to a preferred implementation as illustrated in FIGS. 5A-5D, locking element 202 and its support configuration 206, 208, as well as the complementary features of panel 104 are configured such that, when the panel is displaced from the open position towards the closed position, panel 104 displaces locking element 202 temporarily from the locked position towards the unlocked position to allow displacement of the panel to the closed position. This ensures that the locking arrangement does not obstruct closing of the panel, and that the lock mechanism does not need to be operated in order to close the panel. FIGS. 5A-5C show three stages of displacement of locking element 202 during the closing movement of the panel, while FIG. 5D shows the locking element having returned to its locked position when the panel reaches its fully closed state. Here too, motion of the locking element to its locked position may be caused by a biasing element such as a spring (not shown). Additionally or alternatively, a linkage may be provided, such as is taught in US Patent Application Pre-Grant Publication US2017/0152676A1, to mechanically link closure of the panel with deployment of the locking element to its engaged state.

In addition to, or as an alternative to, a mechanical handle, various embodiments of the present invention may be operated by a powered actuator, for example, an electrically operated actuator, which is deployed to provide a release mechanism to controllable displace the locking element from its locked position to an unlocked position. A wide range of types of electrically operated actuator may be used, including but not limited to, solenoids and various motor-operated mechanisms.

Provision of a powered actuator to release locking of the panel may be useful in a range of circumstances where local or remote electronic control, or other remote control, is required. Examples include but are not limited to: push-button release systems, intercom systems, keypad code-operated systems, smart card and wireless access control systems, and various emergency access and emergency building evacuation arrangements. The additional system components (e.g., power supply, logic controller and communication interfaces) required to support all such applications are well known in the art, and will not be addressed here in detail.

Figure 6A:
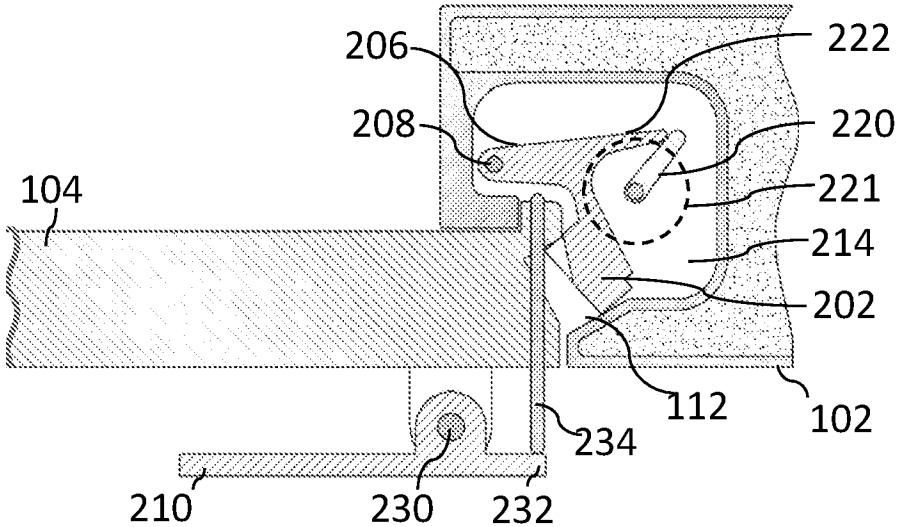
FIGS. 6A-6E are views similar to FIG. 4A showing a sequence of states of the mechanism during opening of the panel when unlocked using an electric actuator.
Figure 6B:
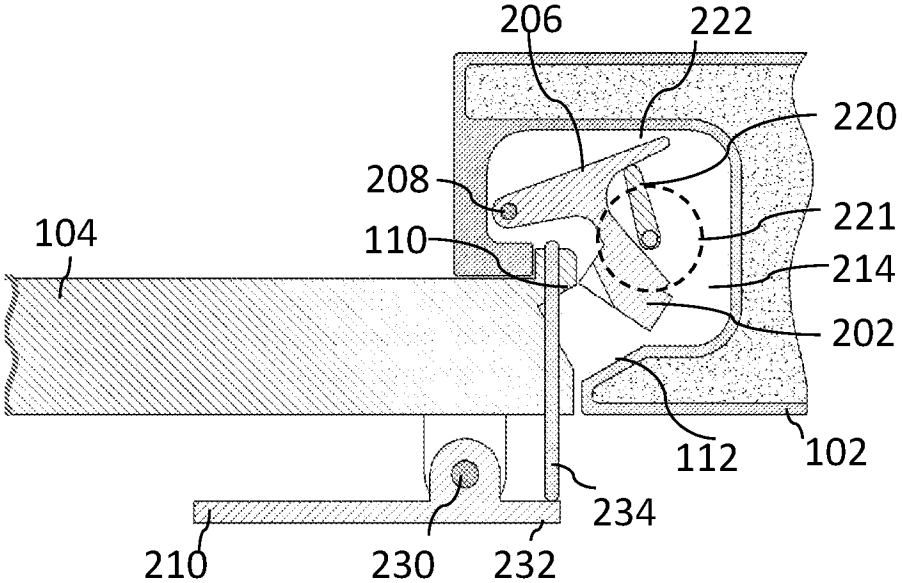
Figure 6D:
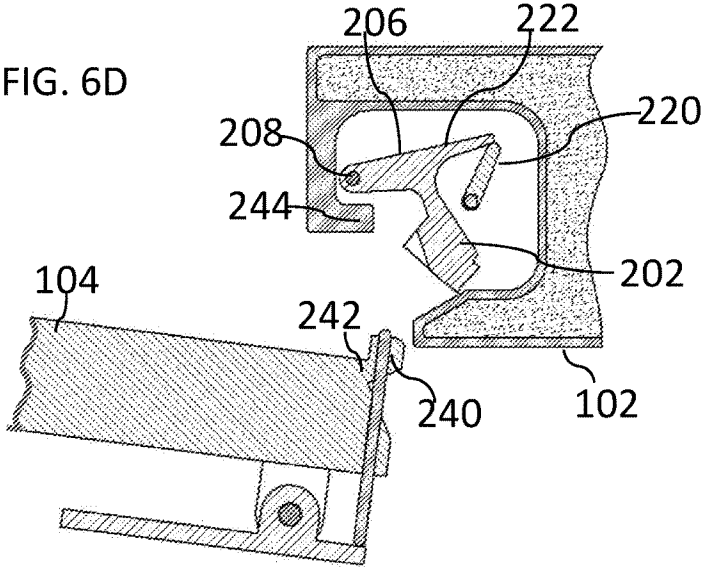
Figure 6C:
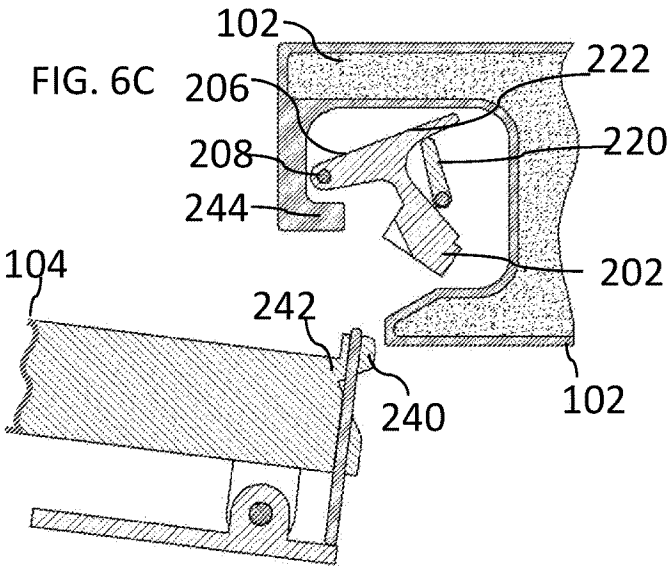
Figure 6E:
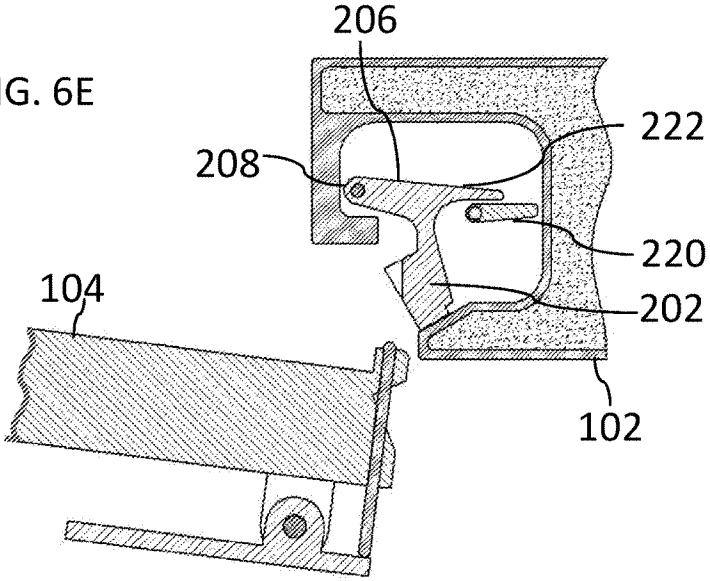
Figure 7:
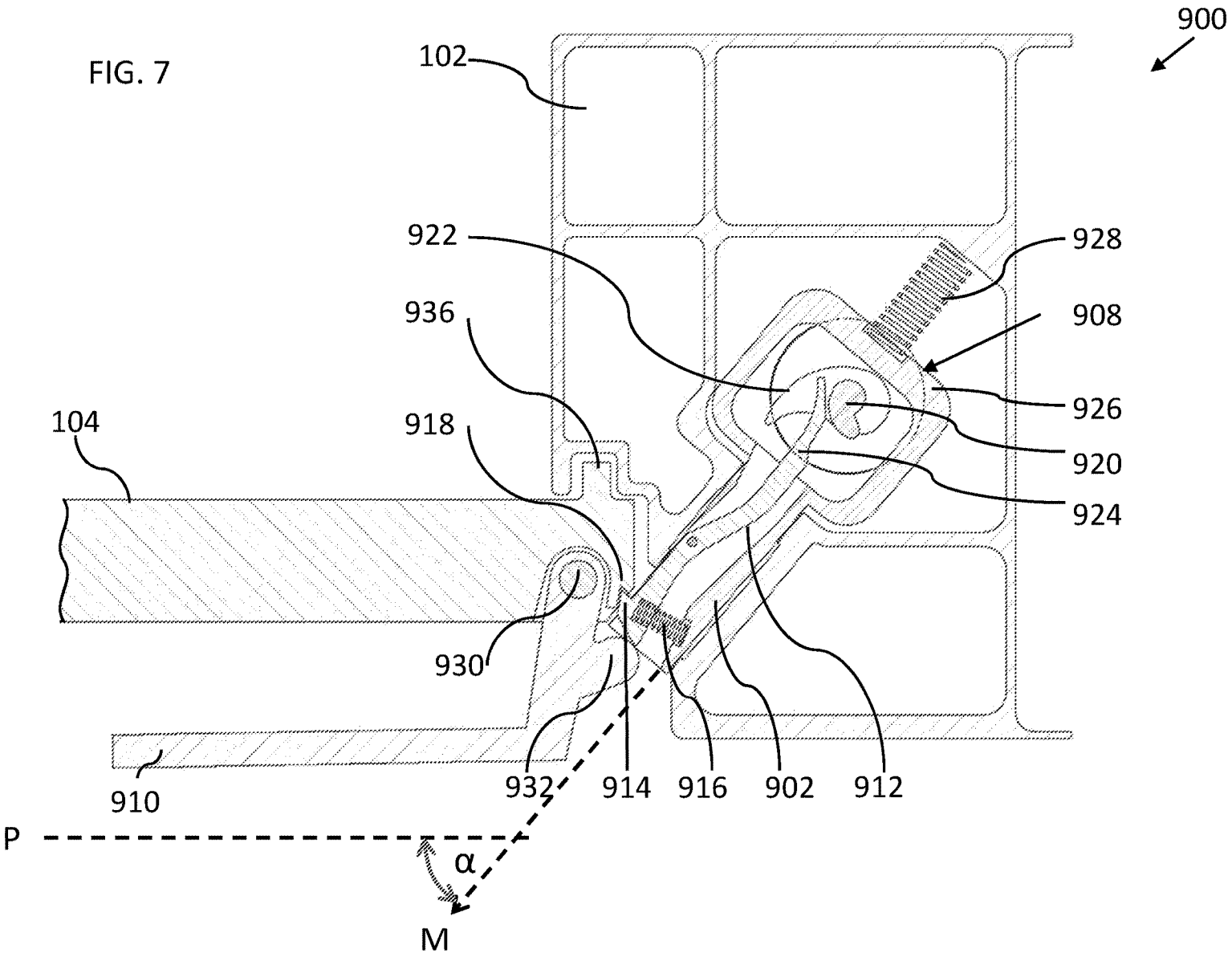
FIG. 7 is a schematic partial horizontal cross-sectional view taken through a second embodiment of the apparatus of FIG. 1 taken on a horizontal plane passing through the handle of the panel.

In the non-limiting example illustrated in FIGS. 6A-6E, a rotary actuator 221 (located above the plane of the cross-section but represented in FIGS. 6A and 6B by a dashed outline) is deployed to rotate an actuator lever 220 from an initial position as shown in FIG. 4A through a range of angles as illustrated in FIGS. 6A and 6B, thereby engaging and displacing an extension flap 222 of supporting structure 206 so as to pivot supporting structure 206 about axle 208, thereby withdrawing locking element 202 from between pressure surface 110 and contact surface 112. Once the locking element reaches its fully withdrawn position as shown in FIG. 6B, panel 104 can be swung open without hindrance, as shown in FIG. 6C. Typically after a short delay, the rotary actuator initiates a return motion of actuator lever 220 as shown in FIGS. 6D and 6C, allowing locking element 202 to return to its locked position under spring bias, as described earlier. In this state, the mechanism is again ready to allow closing of the panel according to the sequence described above with reference to FIGS. 5A-5D. Although illustrated here in an implementation employing a rotary actuator, this and other applications of the invention could also be implemented using various linear actuators, motors or other powered actuators of any sort.

The handle and powered-actuator implementations discussed above, and elsewhere in this description, are only examples of a range of different actuation mechanisms which can be implemented with the present invention. More generically, the locking element may be displaced from its locked position towards its unlocked position by any suitable actuation mechanism including a suitable mechanical coupling. The coupling may include, or interact with, a manually operated handle, a cylinder lock, and/or a powered actuator, each of which may be mounted on the panel or on the frame according to the details of the desired implementation.

In certain particularly preferred implementations such as is illustrated here, it will be noted that the locked configuration of the apparatus provides an anchoring effect which achieves positive retention of the panel against a wide range of load conditions which might cause flexing of the panel and/or rotation of the panel. Specifically, as best seen in FIG. 4A, panel 104 is here formed with an enlarged corner strip 240 which has dimensions greater than a connecting region 242 which connects the corner strip to the main part of the panel. Most preferably, the transition between the connecting region 242 and the corner strip 240 is marked by a step which projects roughly perpendicular to the plane of the panel (corresponding to the plane of closure when in the closed position). This step lies adjacent to a complementary abutment surface 244 of frame 102 when the panel is closed, so that a gap between abutment surface 244 and the surface of locking element 202 facing pressure surface 110 is smaller than the transverse dimension of corner strip 240. This prevents extraction of the corner strip of the panel from the frame in the locked state until locking element 202 is retracted. Although illustrated here as a "corner strip", it will be clear that similar properties can be achieved using a projecting ridge, such as ridge 936 disclosed below in the context of FIG. 7, or a reverse configuration where a ridge projecting from the frame engages a recess in the panel, or any other geometrical form of the panel and frame configured such that a clearance between the locking element and a part of the frame is smaller than the corresponding dimension of part of the panel which needs to pass through that gap in order to extract the panel from the frame.

The assembly illustrated here has been illustrated in a non-limiting implementation without integrating a stop latch ("deadlock") mechanism. Due to the positioning of the locking element enclosed within an internal cavity 214 of frame 102, implementations without a deadlock mechanism may be sufficient. It should be noted however, that the both a power-actuated release mechanism and a manually operated mechanism can readily be implemented with a suitable deadlock configuration, where the initial motion of the handle and/or actuator is effective to release a stop latch (deadlock) before it starts to displace locking element 202, all as is known in the art.

The above example employs an arcuate motion of the locking element between its locked and unlocked states. It should be noted however that the present invention is not limited to such implementations, and can alternatively be implemented using other support configurations which define other types of motion of the locking element, so long as the terminal part of the motion occurs in a direction M according to the teachings of the present invention. By way of one further non-limiting example, FIGS. 7-11 illustrate various implementations in which a path of motion of the locking element is a linear path of motion.

Turning now to FIGS. 7-11, there is shown a latch arrangement, generally designated 900, in which a frame-mounted retractable locking element 902 is interposed between a panel 104 and a frame element 102 through a motion in a direction M oblique to the plane of closure P of the panel within the frame. In the non-limiting example illustrated here, locking element 902 is mounted to move through a linear sliding motion at an angle $\alpha$ that is preferably between 10° and 60° to the plane of closure, and most preferably between about 20° and about 45° to the plane of closure P. Non-linear motion of the locking element, such as a rotary motion or a more complex compound motion, may also be used so long as the relevant part of the motion for engaging and disengaging between the panel and frame is an obliquely directed motion as stated. As above, insertion of a locking element obliquely at such angles, together with suitably oriented pressure surfaces on both the panel and frame, provides highly effective locking of the panel, where forces acting to open the panel are converted primarily to compression forces acting on the locking element.

The "support configuration" in this context may be any structure which supports locking element 902 for sliding motion in the direction of motion M. For a relatively small locking element 902, this may simply be a set of flat abutment surfaces against which locking element 902 slides. In other cases, and particularly for implementations in which locking element 902 is enlarged in the direction perpendicular to the cross-section shown, so as to extend along a significant proportion (for example, at least 10%, or in some cases a majority) of the corresponding dimension of the panel, the locking element is preferably supported by a guide mechanism, which may include linear bearings and/or a mechanism such as a scissors mechanism for ensuring that the upper and lower parts of the locking element move in parallel motion.

In the preferred embodiment illustrated here, latch arrangement 900 provides for both powered operation by a rotary actuator 908 mounted on frame element 102 and manual operation by a panel-mounted handle 910, and includes a deadlock mechanism which is released by each of these modes of operation. Specifically, locking element 902 here includes a pivotally-mounted stop-latch element 912 which has an engagement tooth 914 which is biased by a spring 916 to engage a complementary recess 918 in panel 104. This engagement provides deadlock functionality, obstructing displacement of locking element 902 from its locked position to an unlocked position. Although illustrated here in an implementation employing a rotary actuator, this embodiment could clearly also be implemented conveniently using a linear actuator.

Rotary actuator 908 includes an actuator body (shown only in FIG. 7, and omitted elsewhere for clarity of presentation) which rotates a double cam assembly including a first cam 920 and a second cam 922 that are rigidly interconnected. First cam 920 is deployed to act on a tail portion 924 of stop-latch element 912. Second cam 922 is deployed to act on a frame 926 that is integrated with locking element 902. A spring 928 biases frame 926 and hence also locking element 902 to a locked position.

Figure 8B:
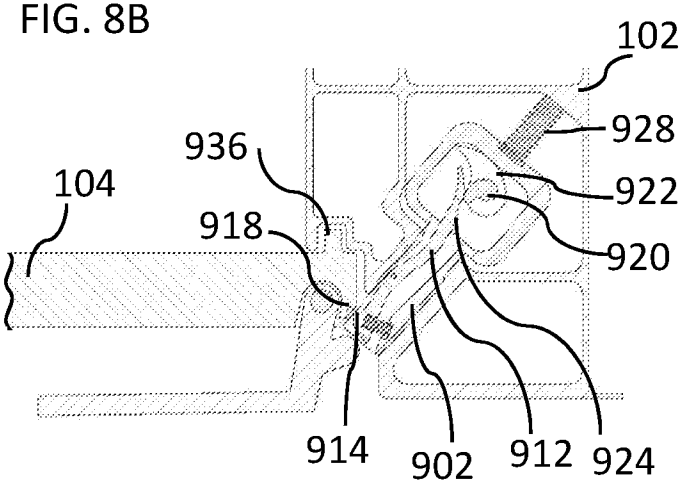
FIGS. 8A-8C are a series of views similar to FIG. 7 illustrating a sequence of operations for powered actuation of the latch arrangement.
Figure 8A:
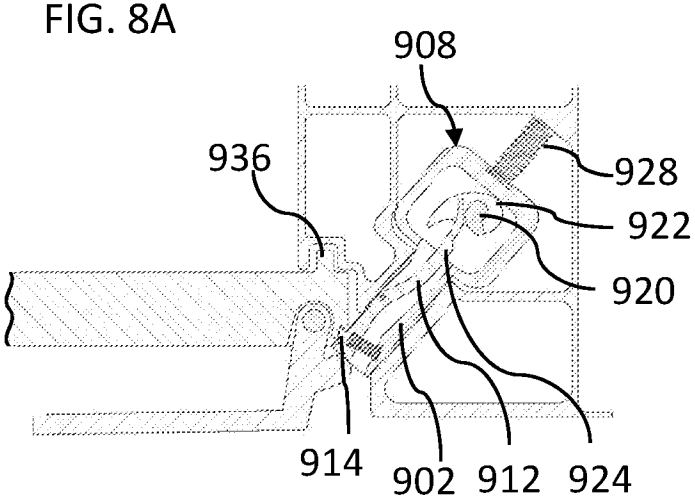
Figure 8C:
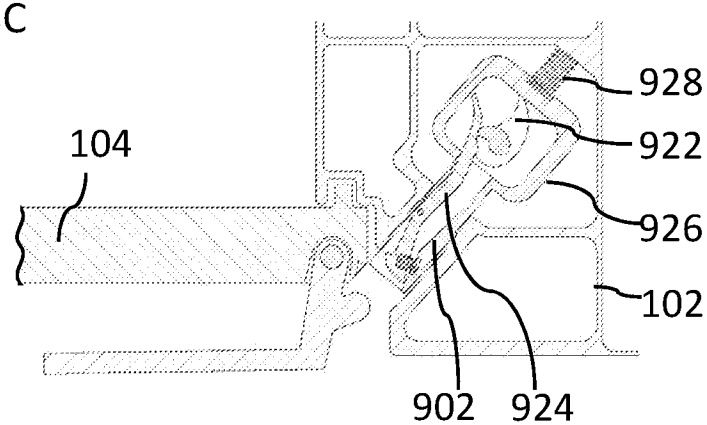

A sequence of operation for unlocking of the panel by rotary actuator 908 is illustrated in FIGS. 8A-8C. FIG. 8A illustrates the initial locked state, equivalent to FIG. 7. On operation of the rotary actuator 908, the double cam assembly begins to rotate, and first cam 920 bears on tail portion 924 of stop-latch element 912, causing it to rock about its pivot axis and disengage tooth 914 from recess 918 (FIG. 8B). Further rotation of the double cam assembly brings second cam 922 to bear on the inside of frame 926, thereby displacing locking element 902 to as to withdraw the locking element to an unlocked position (FIG. 8C) in which it no longer obstructs opening of the panel. Typically, after a predetermined period of time, the rotary actuator returns in the opposite direction (anticlockwise as shown) to its starting position, allowing spring 928 to return locking element 902 to its locking position, either relocking panel 104 in place or waiting for the panel to be pushed closed (causing temporary resilient retraction of the locking element against the spring) and then relocking.

Figure 9B:
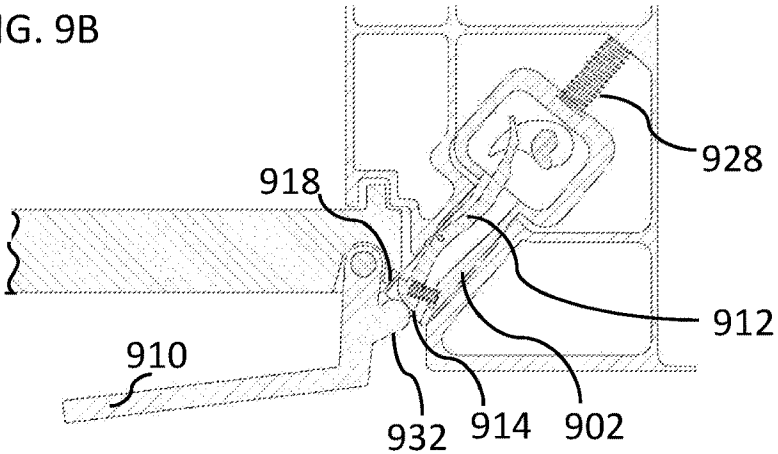
FIGS. 9A-9D are a series of views similar to FIG. 7 illustrating a sequence of operations for manual actuation of the latch arrangement.
Figure 9D:
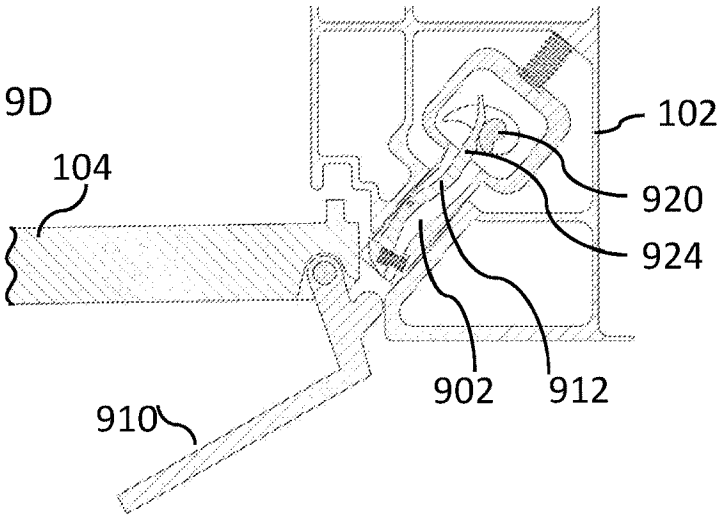
Figure 9A:
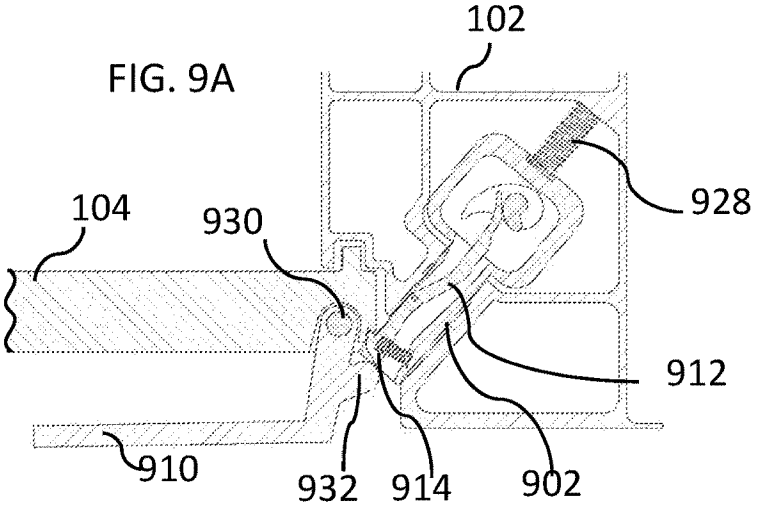
Figure 9C:
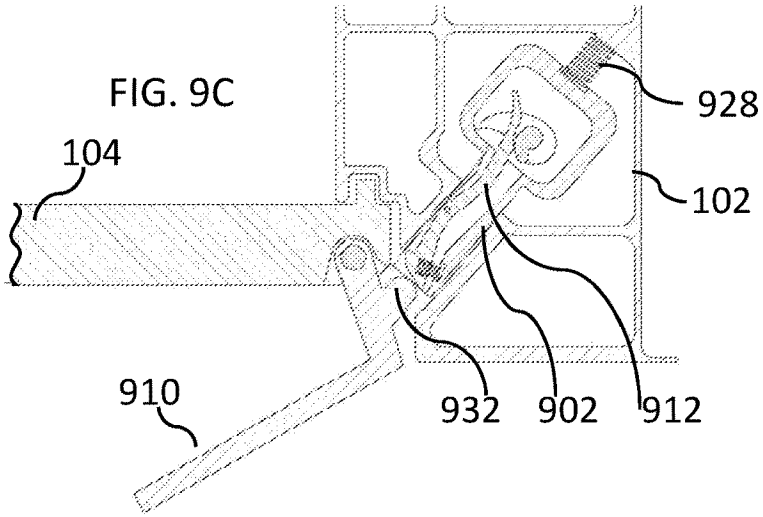

As an alternative to powered actuation, panel 104 can also be opened manually by use of manual handle 910 mounted on the panel. The sequence of manual opening is illustrated in FIGS. 9A-9D. On displacement of handle 910 by pivoting about a pivot axis 930, an actuating projection 932 is brought to bear against an inclined distal end of stop-latch element 912, thereby pivoting the stop-latch element until engagement tooth 914 clears complementary recess 918 (FIG. 9B). Further motion of the handle pushes locking element 902 to retract against the action of spring 928 to a position which allows panel 104 to be opened. Optionally, a curved profile of tail portion 924 of stop-latch element 912 is formed such that, during retraction of locking element 902, contact of tail portion 924 with first cam 920 rocks stop-latch element 912 sufficiently to avoid frictional rubbing of engagement tooth 914 with the walls of the channel within which locking element 902 is mounted. As the panel starts to move, locking element 902 is maintained in its retracted state by contact with the edge of the panel, until the panel has passed, at which point the locking element returns to its default locked position, ready to relock the door when closed.

Figure 10:
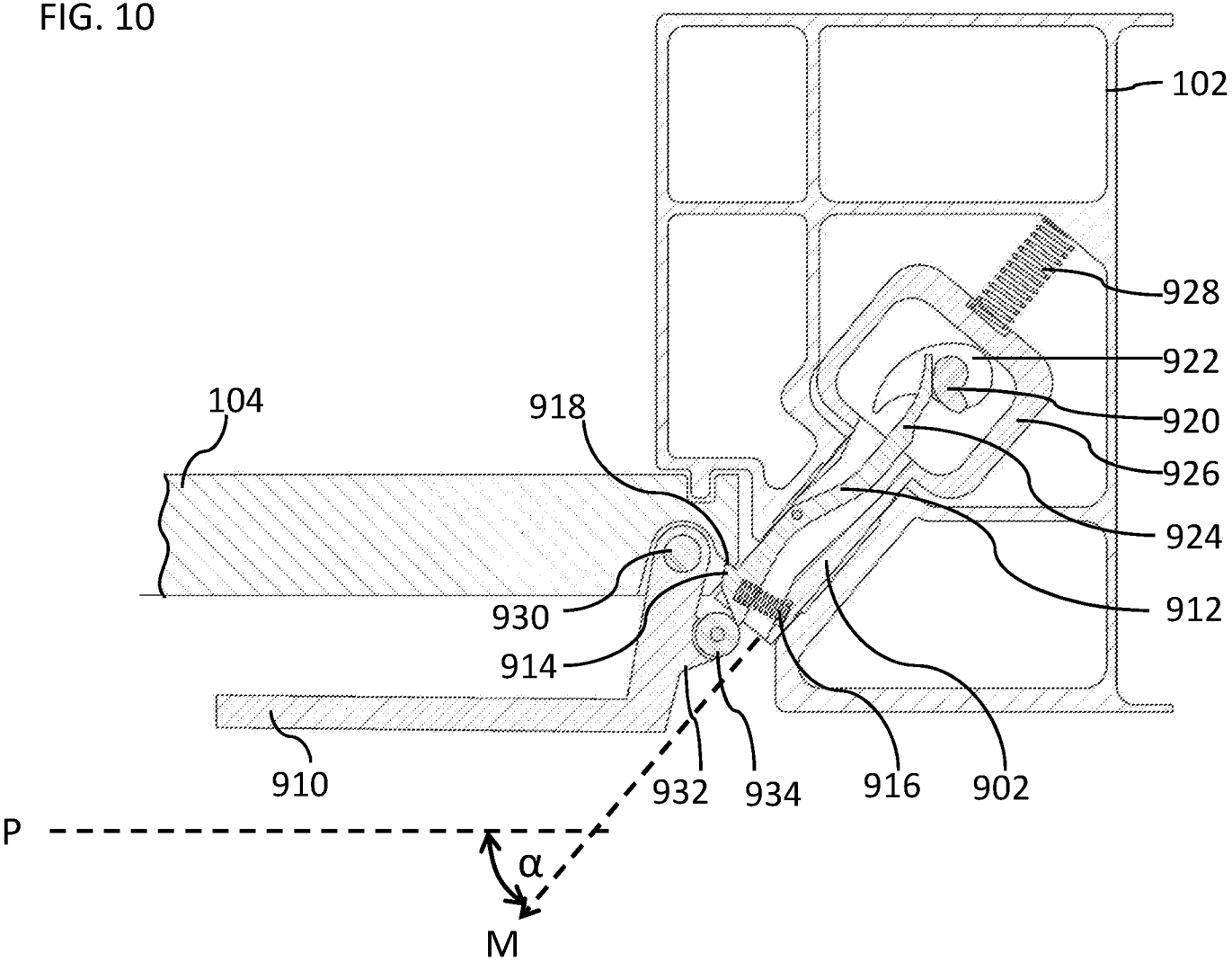
FIG. 10 is a view similar to FIG. 7 illustrating a variant implementation of the latch arrangement with addition of a friction-reducing roller element.

FIG. 10 shows a modification of latch arrangement 900 in which actuating projection 932 is provided with a roller element, such as roller bearing 934, to reduce frictional resistance between actuating projection 932 and stop-latch element 912. The roller bearing may be implemented using any rolling element which is effective to reduce friction. Most preferably, a ball bearing assembly or cylindrical roller bearings are used for highly effective friction reduction. Such bearings are per se well known, and will not be described here in detail. It should be understood that roller elements or bearings of this type may be included with any of the embodiments of the present invention described herein, as will be clear to a person ordinarily skilled in the art.

Figure 11:
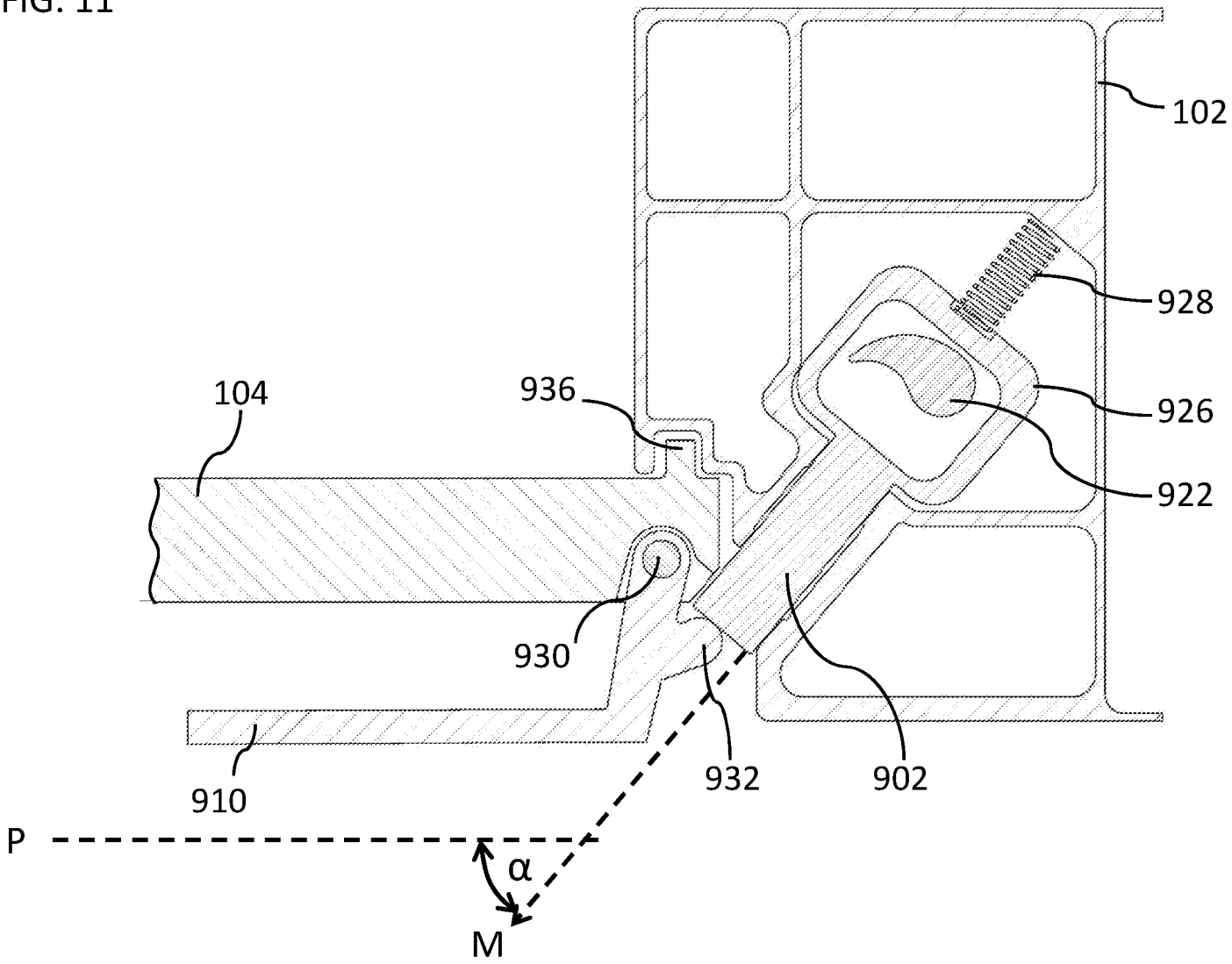
FIG. 11 is a view similar to FIG. 7 illustrating a simplified implementation of the latch arrangement.

FIG. 11 shows a simplified version of latch arrangement 900 without a deadlock mechanism. In this case, the structure of locking element 902 is simplified to a solid block, and only a single cam mechanism is used for powered actuation. The direction of motion of the locking element inherently makes it relatively difficult to displace by insertion of tools or flexible elements around the edge of the panel from the outside, and this protection is preferably further enhanced by the use of a male/female ridge-and-slot engagement 936, such that a deadlock mechanism may not in fact be required. In all other respects, the structure and function of the latch arrangement of FIG. 11 is the same as that of latch arrangement 900 detailed above.

The embodiment of FIGS. 7-11 may be implemented with either a localized bolt-like locking element, or with an elongated locking tongue which extends along a significant proportion of the corresponding dimension of the panel, for example, at least 10%, and in some cases a majority. Where an elongated locking tongue is used, the other elements illustrated here (handle, deadlock, power-actuator etc.) are typically localized, for example, near the middle of the height of the locking element.

To the extent that the appended claims have been drafted without multiple dependencies, this has been done only to accommodate formal requirements in jurisdictions which do not allow such multiple dependencies. It should be noted that all possible combinations of features which would be implied by rendering the claims multiply dependent are explicitly envisaged and should be considered part of the invention.

It will be appreciated that the above descriptions are intended only to serve as examples, and that many other embodiments are possible within the scope of the present invention as defined in the appended claims.

What is claimed is:

1. An apparatus comprising:

(a) an opening at least partially bounded by a frame, said frame defining a plane of closure;

(b) a panel swingably mounted relative to said frame so as to be swingable between an open position removed from said opening and a closed position in which said panel is aligned parallel to said plane of closure;

(c) a locking element; and (d) a support configuration deployed for supporting said locking element so as to be displaceable between a locked position in which at least part of said locking element is interposed between a pressure surface defined on said panel and a contact surface defined on said frame, thereby locking said panel to said frame, and an unlocked position in which said locking element is removed from between said pressure surface and said contact surface, thereby unlocking said panel from said frame, wherein said support configuration is configured to define a path of motion of said locking element from said unlocked position to said locked position, and wherein at least a terminal part of said path of motion of an entirety of said at least part of said locking element interposed between said pressure surface and said contact surface when approaching said locked position is in a direction of motion that is obliquely angled relative to said plane of closure.

2. The apparatus of claim 1, wherein said direction of motion is inclined at between 10° and about 60° to said plane of closure.

3. The apparatus of claim 1, wherein said direction of motion is inclined at between 20° and about 45° to said plane of closure.

4. The apparatus of claim 1, wherein said path of motion is a linear path of motion.

5. The apparatus of claim 1, wherein said path of motion is an arcuate path of motion along an arc having a radius greater than a distance between said pressure surface and said contact surface.

6. The apparatus of claim 1, wherein in said closed position, said pressure surface and said contact surface are in facing relation such that force applied to displace said panel towards the open position is opposed by compressive forces applied on said locking element between said pressure surface and said contact surface.

7. The apparatus of claim 1, wherein said panel, said locking element and said support configuration are configured such that, when said panel is displaced from said open position towards said closed position, said panel displaces said locking element temporarily from said locked position towards said unlocked position to allow displacement of said panel to said closed position.

8. The apparatus of claim 1, further comprising an actuation mechanism comprising a mechanical coupling selectively displaceable so as to displace said locking element from said locked position towards said unlocked position.

9. The apparatus of claim 8, wherein said mechanical coupling comprises a manually-operable handle.

10. The apparatus of claim 8, wherein said actuation mechanism further comprises a powered actuator deployed for selectively displacing said mechanical coupling.

11. The apparatus of claim 8, wherein at least part of said mechanical coupling is mounted on said panel.

12. An apparatus comprising:

(a) an opening at least partially bounded by a frame, said frame defining a plane of closure;

(b) a panel swingably mounted relative to said frame so as to be swingable between an open position removed from said opening and a closed position in which said panel is aligned parallel to said plane of closure;

(c) a locking element; and (d) a support configuration deployed for supporting said locking element relative to said frame so as to be displaceable along an arcuate path of motion about a pivot axis between a locked position in which at least part of said locking element is interposed between a pressure surface defined on said panel and a contact surface defined on said frame, thereby locking said panel to said frame, and an unlocked position in which said locking element is removed from between said pressure surface and said contact surface, thereby unlocking said panel from said frame, wherein a tangent to said arcuate path of motion as said locking element approaches said locked position is in a direction obliquely angled relative to said plane of closure, and wherein said pivot axis is located on a side of said plane of closure that is away from a direction to which said panel opens.

13. The apparatus of claim 12, wherein said arcuate path of motion is along an arc having a radius greater than a distance between said pressure surface and said contact surface.

* * * * *